United States Patent [19]

Urrestarazu-Borda

[11] Patent Number: 4,545,226

[45] Date of Patent: Oct. 8, 1985

[54] COMBINATION KEY

[76] Inventor: Rafael Urrestarazu-Borda, Casa Gure-Pakea, Barrio Ayete, San Sebastian, Spain

[21] Appl. No.: 566,523

[22] Filed: Dec. 29, 1983

[30] Foreign Application Priority Data

Feb. 17, 1983 [ES] Spain ..... 270.406[U]

[51] Int. Cl.[4] ..... E05B 19/18

[52] U.S. Cl. ..... 70/411; 70/398

[58] Field of Search ..... 70/411, 398, 399, 395, 70/394

[56] References Cited

U.S. PATENT DOCUMENTS 828,480 8/1906 Ibbott ..... 70/411

939,679 11/1909 Freud ..... 70/411

*Primary Examiner*—Robert L. Wolfe

*Attorney, Agent, or Firm*—Toren, McGeady, Stanger, Goldberg & Kiel

[57] ABSTRACT

A combination key permitting the opening of various different locks with a single key. The combination key has a hollow stem with longitudinally extending slots in which a plurality of teeth can be moved in longitudinal direction. A control mechanism arranged within the key facilitates the movement of the teeth, so that the relative positions of the teeth can be adjusted in accordance with the respective lock to be opened.

4 Claims, 4 Drawing Figures

COMBINATION KEY

BACKGROUND OF THE INVENTION

1. Field of the Invention

The present invention relates to a combination key which permits the opening of various different locks with a single key.

2. Description of the Prior Art

Most conventional locks have a tumbler which is normally blocked and must be turned for opening. The tumbler is blocked by means of a key. More specifically, the tumbler has a lower structure with levers which must assume specific positions for the the unblocking to occur, which positions are determined by the introduction of the key and through the appropriate contours on the operative edge or edges of the key. The turning of the tumbler may cause the taking along of the ward directly or may establish an electric circuit. This causes the actual opening without affecting the structure of the operative lock-key assembly.

Today's lifestyle requires that often a certain person must carry a considerable number of keys to have access to different dwellings provided with corresponding locks. The ideal solution would be to have a single key for opening all locks, but it is clear that such a solution is not feasible because, unless all locks are installed at the same time so that they can easily be identical, it would be very difficult and costly to later obtain one or more locks that would fit a certain key. On the other hand, losing the one and only key would, under certain circumstances, make it necessary to change all the locks which also would be a considerable economic problem.

SUMMARY OF THE INVENTION

I have invented a combination key which overcomes these problems by permitting the use of a common key for different locks without creating a problem by the loss of the key since, without knowing its concrete combination, the key cannot be used for opening any of the locks for which it is intended.

Specifically, the combination key of the invention includes a stem capable of insertion in a wide spectrum of locks, just as a conventional key matrix is able to fit into different locks, the teeth which are to establish the specific combination for each case being cut from the matrix. In accordance with the present invention, the teeth are independent of the stem and displaceable along the latter to vary their position in accordance with different locks.

Thus, starting with a stem of a certain configuration common for all locks of the spectrum, on the stem are installed a series of teeth in variable number, which only with a certain positional combination will permit the opening of a certain lock, while in any other position they would be ineffective for the lock. To effect the opening of another lock, it will suffice to move the teeth until they occupy a different relative position, likewise in accordance with the lock which in this case is to be actuated by the key.

For the displacement of the teeth, the body of the key on which one acts in the manipulation of opening or closing, is provided with a series of control elements or wheels which act on respective transmission means for the displacement of the teeth or notches with which the combination of the key is established.

As is apparent, the greater the number of movable teeth, the greater will be the possibility of the key and, therefore, several teeth are provided on each of its sides. For the same purpose, each tooth is to be provided with a plurality of notches and the notches of each tooth will be different from those of the others.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DESCRIPTION OF THE PREFERRED EMBODIMENT

It can be seen from these figures that the key according to the present invention is composed of one piece and includes a stem 1 and an actuating body 2 which is used to manipulate the key in order to open or close a lock and which has control elements which act to establish the appropriate combination or pattern of the teeth of the key.

Figure 1:
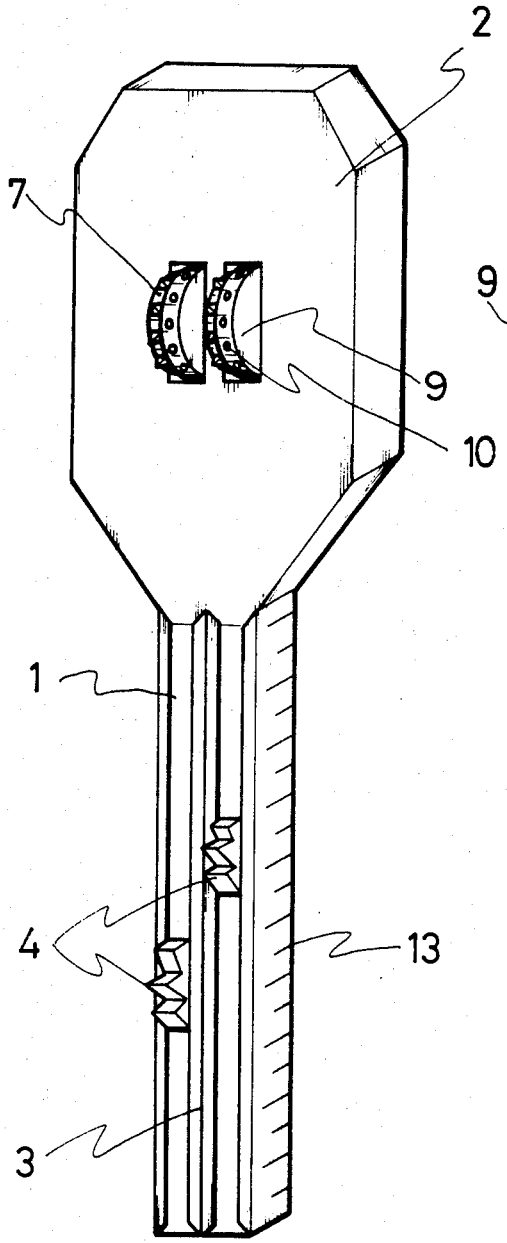
FIG. 1 is a perspective view of a combination key in accordance with the present invention.

On at least one side of the stem 1 or, preferably, on two opposite sides, longitudinal slots 3 are formed which are open toward the hollow interior of the key and in which slide respective teeth 4 provided with irregular random notches as shown in FIG. 1.

Teeth 4 are associated with a movable chain 5 which is arranged in the hollow interior of the stem 1 and extends into the body 2 and is guided by supports 6, so that it forms a circular path.

Upon the chain 5, the practical realization of which offers ample possibilities of variation, there acts a toothed wheel 7 whose teeth are spaced to match entrainment boreholes 8 existing along the periphery of chain 5, toothed wheel 7 being integral with a second wheel 9 provided with seats 10 on its periphery for receiving a spring-biased pin 11 of a blocking mechanism 12 with which an accurate step-by-step rotation of the wheels is established.

Figure 2:
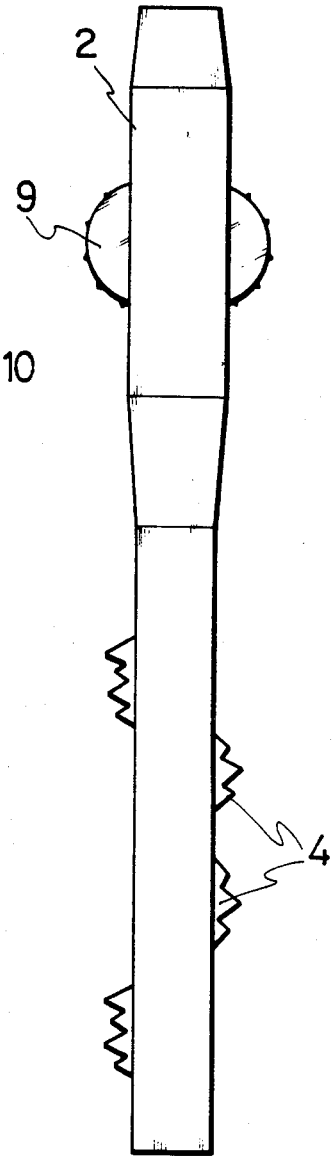
FIG. 2 is an elevational side view of the key of FIG. 1.
Figure 3:
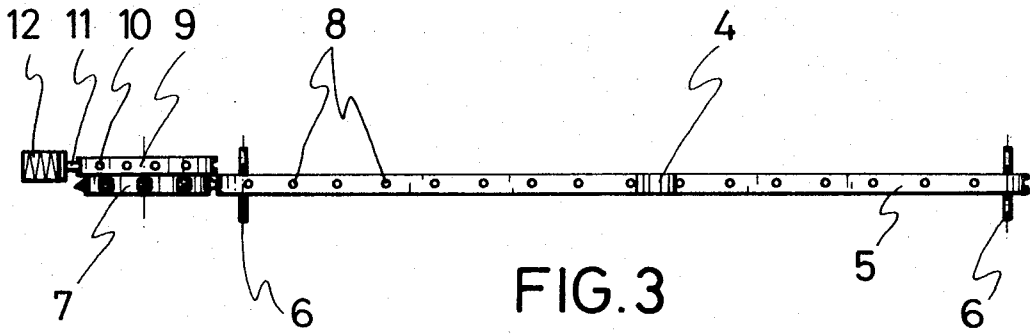
FIG. 3 is a detail view of the mechanism for actuating each tooth of the key of FIG. 1.
Figure 4:
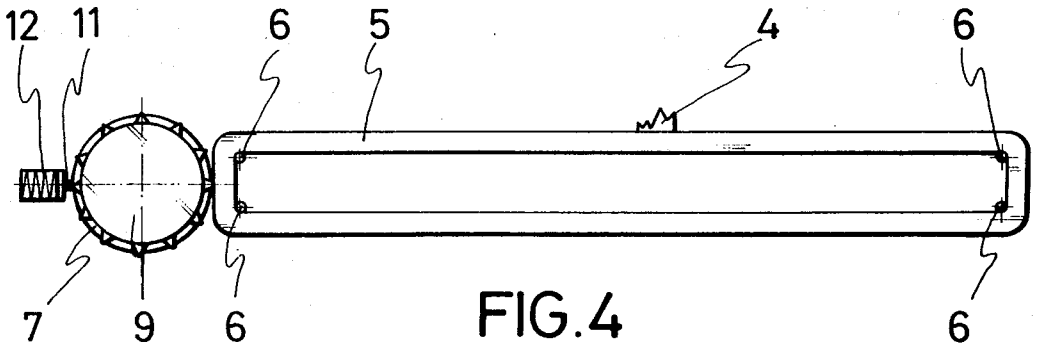
FIG. 4 is a plan view of the mechanism shown in FIG. 3.

The wheels 7 and 9 partially emerge to the outside, as is shown in detail in FIG. 2, so that they can be manipulated by the user to vary the programmation of the key.

The wheels 7 and 9 are preferably marked with alphanumerical symbols which correspond to indicating marks 13 existing on one of the edges of stem 1 and indicating the positioning of the different teeth 4.

It follows from the above that a given general section of stem 1 can be used for a practically unlimited spectrum of different locks by establishing in each of them different zones of actuation for the teeth 4 with notches matching those of each of the teeth existing on the key.

The combination of each lock being known, it can be established on the key simply by properly adjusting the control elements or wheels 7 and 9 emerging at one or both sides of the body 1, the rotation of the wheels causing longitudinal displacement of the teeth 4 along the stem 1 until properly placed in accordance with the lock to be operated.

With the construction described, it follows that not only does a single key permit manipulation on a wide spectrum of different locks, but also the loss of the key does not create any problem since it will constitute a commercial object kept in stock, its functionality and safety residing in the fact that the user only knows the combination corresponding to his locks.

While a specific embodiment of the invention has been shown and described in detail to illustrate the application of the inventive principles, it will be understood that the invention may be embodied otherwise without departing from such principles.

I claim:

1. A combination key, comprising a hollow stem and an actuating body integrally formed with said stem, said stem defining in at least one of its sides a plurality of longitudinally extending slots, a plurality of teeth longitudinally slidably disposed in said slots, and means provided in the interior of said stem for moving said teeth longitudinally in said slots, so that said teeth can be positioned in accordance with the desired pattern, wherein said means for moving said teeth includes at least one chain disposed in the interior of said stem and extending into said actuating body, said teeth attached to said at least one chain, at least one control wheel disposed in said actuating body and in meshed engagement with said at least one chain.

2. The combination key of claim 1 further comprising second wheels concentrically attached to said control wheels, said second wheels having on their peripheries seats for receiving a spring-biased pin, so that a step by step adjustment of said keys can be obtained.

3. The combination key of claim 1 wherein said control wheels have alphanumerical markings thereon.

4. The combination key of claim 3 comprising a marking on one of the edges of said stem for indicating the relative position of said teeth along said stem and in accordance with said alphanumerical markings.

* * * * *